US008596989B2

(12) United States Patent
Badr et al.

(10) Patent No.: US 8,596,989 B2
(45) Date of Patent: Dec. 3, 2013

(54) DUAL INJECTION AIRLIFT PUMP

(75) Inventors: Hassan Mohamed Badr, Dhahran (SA); Wael Hasan Ahmed, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 280 days.

(21) Appl. No.: 13/154,329

(22) Filed: Jun. 6, 2011

(65) Prior Publication Data

US 2012/0308407 A1 Dec. 6, 2012

(51) Int. Cl.
*F04F 1/18* (2006.01)
*F04F 1/06* (2006.01)

(52) U.S. Cl.
USPC ..... 417/108; 417/118

(58) Field of Classification Search
USPC ..... 417/108, 109, 110, 11, 112, 113, 114, 417/115, 117, 118, 111
See application file for complete search history.

(56) References Cited

U.S. PATENT DOCUMENTS 1,510,105 A * 9/1924 Richmond ..... 417/108
1,777,536 A * 10/1930 Taylor ..... 417/143
2,008,114 A * 7/1935 Taggart ..... 417/109
2,038,441 A * 4/1936 Patterson ..... 417/86
2,062,799 A * 12/1936 Scott ..... 417/108
3,028,817 A 4/1962 Cunetta
3,282,226 A * 11/1966 Repp ..... 417/108
3,765,727 A * 10/1973 Santangelo et al. ..... 406/153
4,373,867 A 2/1983 Campbell
4,551,042 A * 11/1985 Hagedorn et al. ..... 406/93
5,382,137 A 1/1995 Lane
7,267,328 B2 9/2007 Witheridge
7,820,050 B2 10/2010 Cote et al.
2004/0182778 A1 9/2004 Hanlon
2009/0047140 A1 2/2009 Burns

* cited by examiner

*Primary Examiner* — Devon Kramer
*Assistant Examiner* — Lilya Pekarskaya
(74) *Attorney, Agent, or Firm* — Richard C. Litman

(57) ABSTRACT

The dual injection airlift pump has a hollow tubular body through which the liquid being pumped passes upward from the lower intake end to the upper outlet end. Air or other gas is injected into the liquid in the pump body, the less dense gas adding buoyancy to the liquid and entraining the liquid to rise toward the outlet end. The dual injection airlift pump includes two air injection stages, with the first or lower stage having a perforated interior sleeve allowing the gas to pass therethrough to be injected radially into the liquid. The second, upper stage has an impervious sleeve defining a gap between the sleeve and the interior surface of the pump wall, the lower end being sealed and the upper end open. Air is injected between the sleeve and pump wall, the air exiting at the upper or downstream end in an axially peripheral flow pattern.

11 Claims, 3 Drawing Sheets

DUAL INJECTION AIRLIFT PUMP

BACKGROUND OF THE INVENTION

1. Field of the Invention

The present invention relates to fluid transfer devices, and more particularly to a dual injection airlift pump having both radial and axially peripheral air or gas injection.

2. Description of the Related Art

The general concept of the airlift pump has been known for quite some time. Airlift pumps generally comprise a vertically oriented tubular pump body through which the liquid that is being pumped passes. One or more air (or other gas) injection passages are provided in or with the pump body. The airlift pump contains no moving parts, but rather depends upon the injection of air (or other gas) into the pump interior to lift a liquid passing through the pump. The lighter air or gas bubbles upwardly through the liquid in the tubular pump body, increasing the buoyancy of the liquid and causing it to rise in the vertically oriented tubular body. Pumps operating by this principle do not produce high pressure heads, but are capable of moving volumes of liquid reasonably efficiently with relatively low energy input.

Nevertheless, there is room for increased efficiency with conventional airlift pumps. The conventional airlift pump includes a single stage of air or gas injection, generally by means of an externally disposed air delivery line that extends downward along the outside of the pump body to inject air into the bottom or inlet end of the pump. The provision of only a single point discharge for the air or gas entering the pump body results in a relatively narrow bubble stream through the liquid in the pump body, with such a narrow stream failing to add buoyancy and entrain the majority of the volume of liquid in the pump body. Moreover, the expanding gas bubbles at the lower end or inlet of the pump body tend to produce at least some restriction to liquid flow entering the pump.

Thus, a dual injection airlift pump solving the aforementioned problems is desired.

SUMMARY OF THE INVENTION

The dual injection airlift pump comprises a hollow, tubular pump body having a lower or upstream portion and an upper or downstream portion, the liquid flowing through the pump body from its bottom or inlet end upward to exit its upper or outlet end. Air, or other gas, is injected into the pump body to add buoyancy to the liquid within the pump body and to entrain the liquid with the rising bubble flow within the pump, thereby causing the liquid to rise as well. The dual injection airlift pump preferably includes a lower air or gas injection area or portion, and an upper air or gas injection area or portion. Both of these air or gas injection areas preferably inject the air or gas in a symmetrical pattern into the liquid within the pump body, using either radially or axially oriented gas flow.

The lower portion includes an inner sleeve having a large number of radial passages therethrough, the air or gas passing through these passages in the sleeve in a radial direction to be distributed symmetrically through the liquid within the lower portion of the pump. The upper portion includes an impervious inner sleeve sealed to the pump wall at its lower end and open at its upper end. Air is injected through passages in the pump wall to flow in an axial direction between the pump wall and the impervious sleeve, where the air escapes through the open gap between the pump wall and the upper end of the sleeve. This axial peripheral gas flow provides some separation between the relatively dense liquid and the inner surface of the pump wall, thereby reducing hydrodynamic friction between the liquid and the surface of the pump wall. The upwardly directed axial peripheral gas flow, i.e., toward the downstream or outlet end of the pump, also assists in entraining the liquid, as well as adding further buoyancy to the liquid to further assist its upward flow through the pump. The result of the dual air injection and the specific direction of airflow results in significantly increased efficiency for the present airlift pump, in comparison to conventional airlift pumps.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The dual injection airlift pump is a dual stage device having two levels or stages of air or other gas input to the pump body. One level or stage delivers the air or other gas radially into the liquid flow passage, and the other level or stage delivers the air or other gas into the liquid flow passage via an axially peripheral path for increased efficiency. The dual injection airlift pump may use air as the liquid entraining gas, or some other gas (e.g., nitrogen, carbon dioxide, helium, etc.) as the liquid-entraining-gas, if desired. It will be understood in the following disclosure that the terms "air" and "gas" may be used interchangeably when referring to the air or gas used to entrain and add buoyancy to the liquid stream (e.g., water, oil, or other liquid) passing through the pump.

Figure 1:
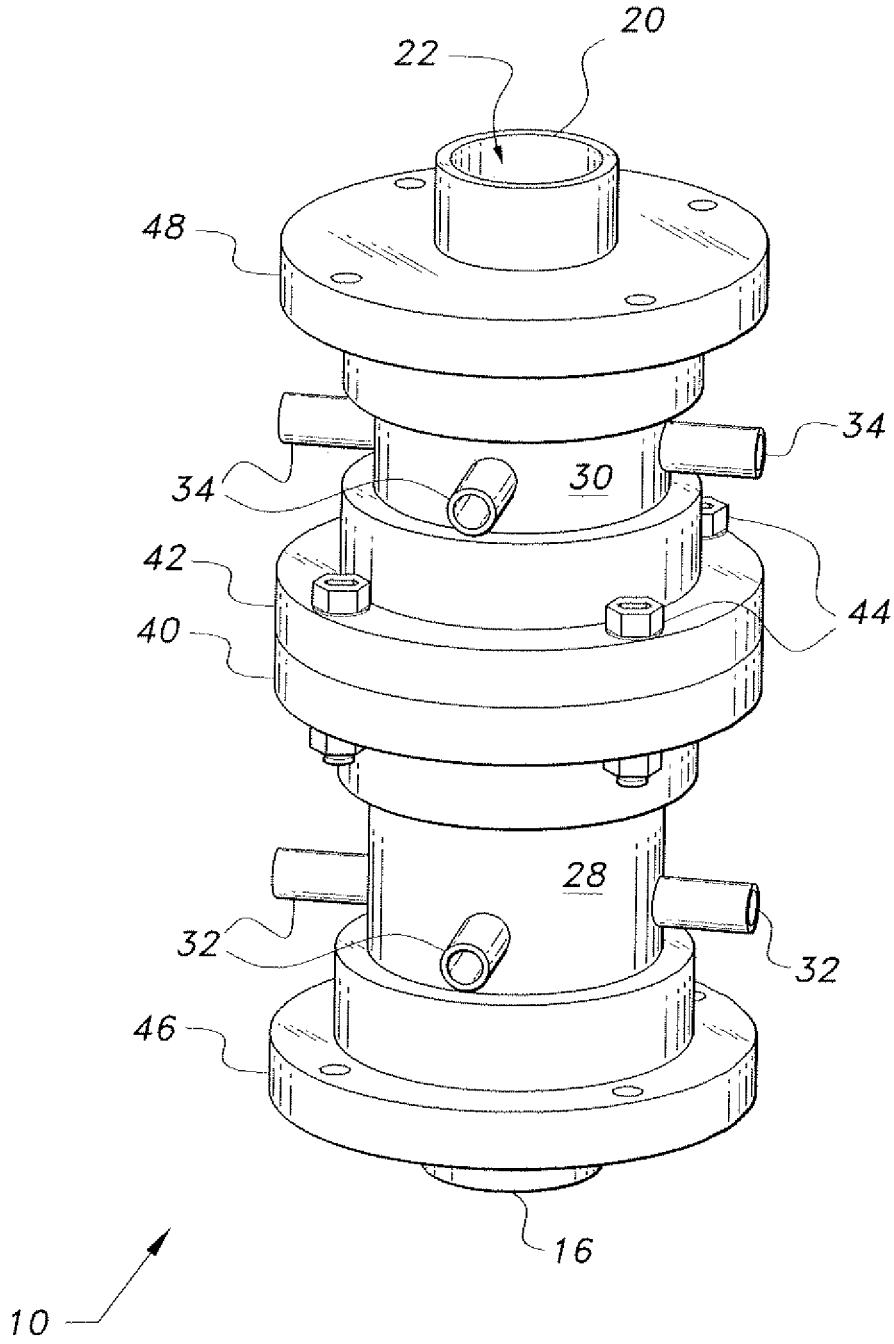
FIG. 1 is a perspective view of a dual injection airlift pump according to the present invention, illustrating its general configuration.
Figure 2:
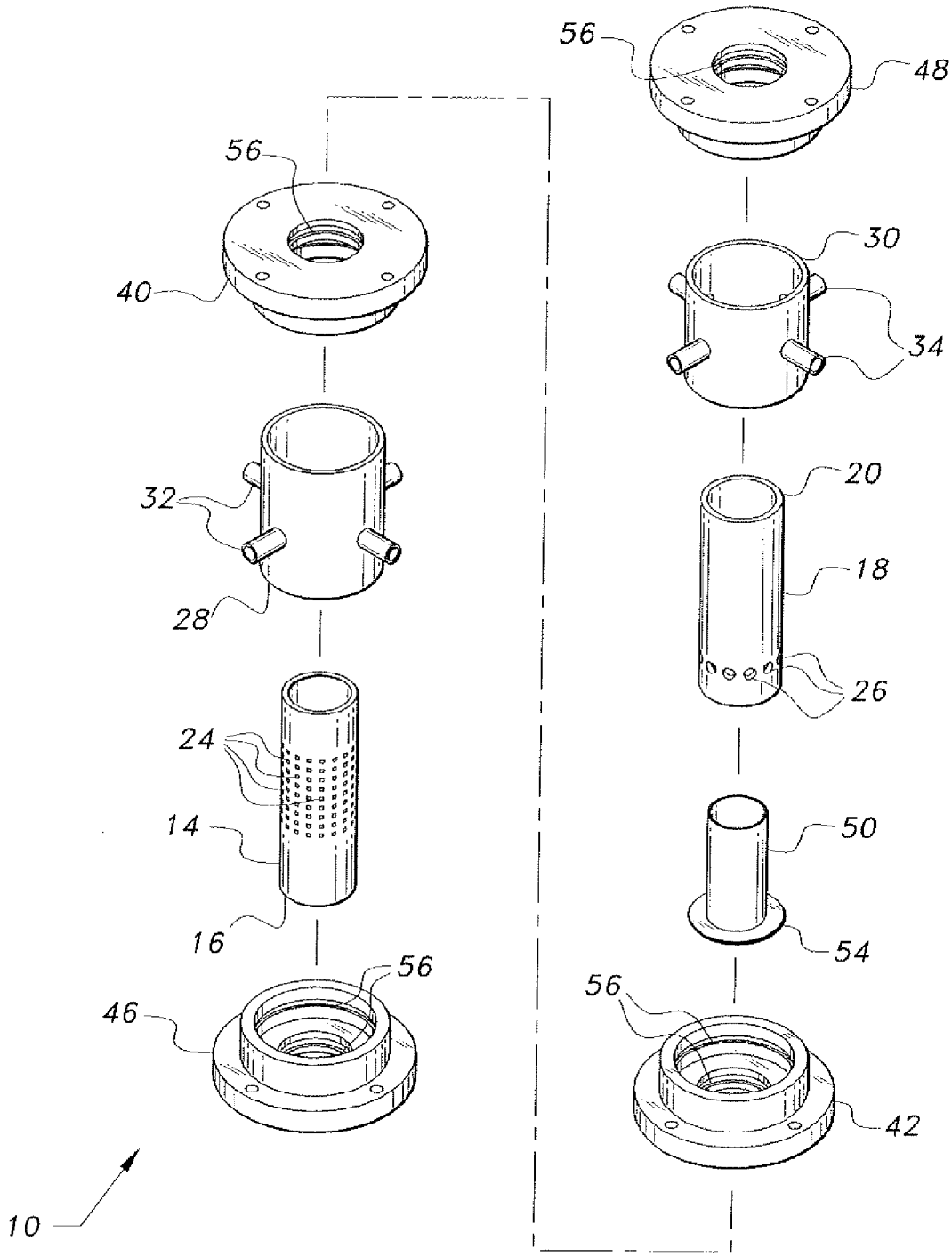
FIG. 2 is an exploded perspective view of the dual injection airlift pump of FIG. 1, illustrating its components and their relationship to one another.
Figure 3:
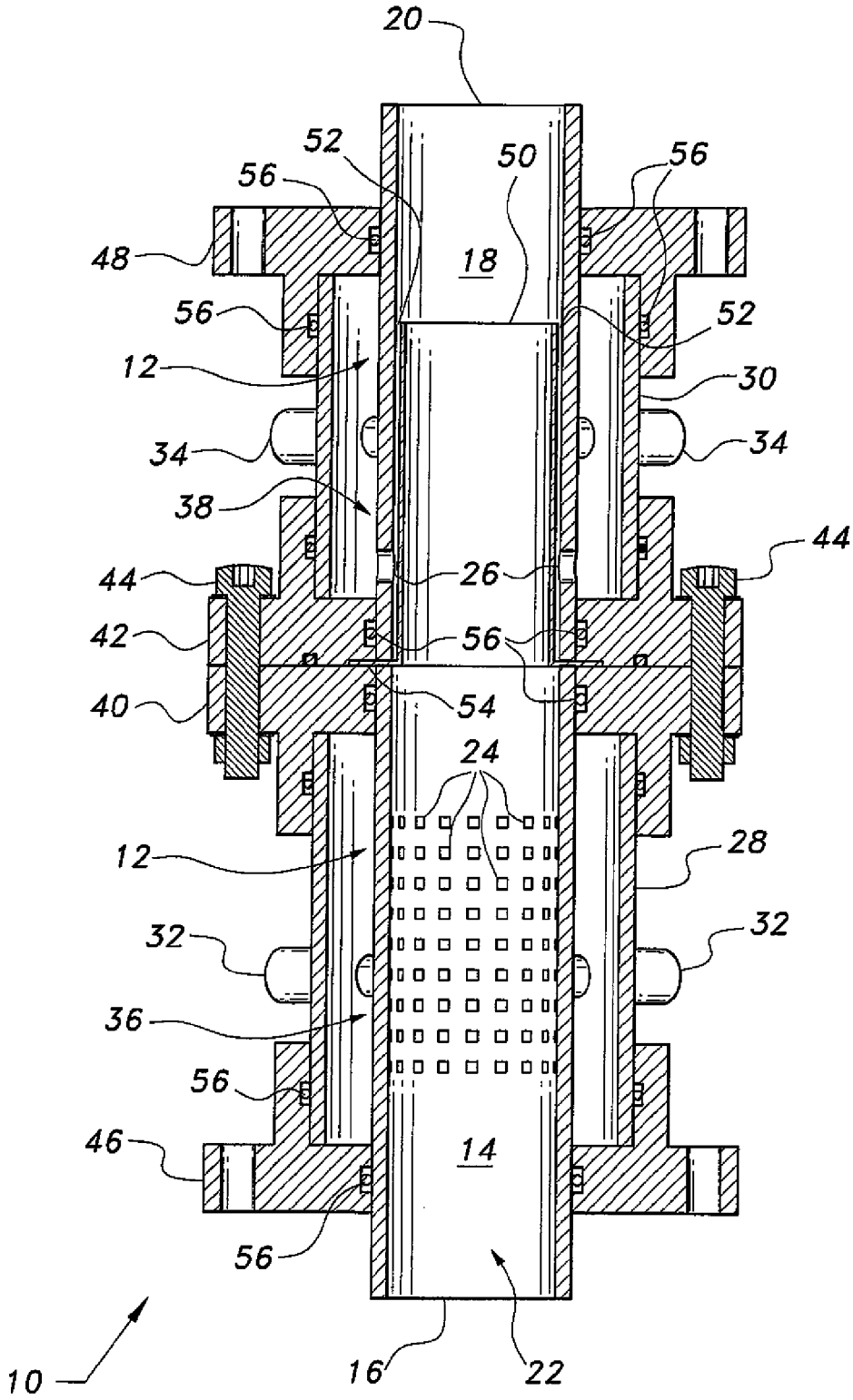
FIG. 3 is an elevation view in section of the dual injection airlift pump according to the present invention, illustrating the fluid flow paths therethrough.

FIG. 1 of the drawings is an illustration of an exemplary dual injection airlift pump 10 according to the present invention. FIG. 2 illustrates the various components of the pump 10 (connecting fasteners are not shown in FIG. 2, for clarity in the drawing). FIG. 3 provides an elevation view in section of the assembled pump 10 of FIG. 1. The dual injection airlift pump 10, generally referred to as pump 10, comprises a hollow, tubular pump body 12 (FIG. 3) having a lower portion 14 defining a lower or inlet end 16, and an upper portion 18 defining an upper or outlet end 20. The two portions 14 and 18 join concentrically and define an axial liquid flow passage 22 therethrough. It should be noted that while the passage 22 is most clearly shown and indicated at the outlet end 20 of the device in FIG. 1 of the drawings, the flow actually passes into the lower inlet end 16, then upward through the device, and then out from the upper outlet end 20.

The lower portion 14 of the pump body 12 includes a large number of relatively small first gas flow passages or perforations 24 formed radially through the wall thereof in an even and symmetrically distributed circumferential array. The upper portion 18 of the pump body 12 has a plurality of second gas flow passages 26 extending radially through the wall thereof, also in an even and symmetrically distributed circumferential array. A first or lower gas delivery collar 28 concentrically surrounds the lower portion 14 of the pump body 12. A second or upper gas delivery collar 30 concentrically surrounds the upper portion 18 of the pump body. Each of the gas delivery collars 28 and 30 includes a plurality of circumferential gas delivery tubes 32 and 34 distributed symmetrically therearound and extending radially therefrom. The inner diameters of the two gas delivery collars 28 and 30 are sufficiently large as to provide a space between the collars 28, 30 and their respective portions 14 and 18 of the pump body 12, thereby defining first and second toroidal gas delivery plenums, respectively 36 and 38, between each collar 28, 30 and its respective pump body portion 14, 18, as shown in FIG. 3.

The lower or first portion 14 of the pump body 12 has a first medial flange 40 attached thereto opposite its lower end 16. The upper or second portion 18 of the pump body has a second medial flange 42 attached thereto opposite its upper end 20. The two medial flanges 40 and 42 are quite similar (but not identical) to one another, but are in mirror image to provide for assembly of the two portions of the pump 10 by means of appropriate fastener assemblies 44, e.g., Allen bolts and nuts, etc. Again, the fasteners 44 are not shown in FIG. 2 of the drawings for clarity in the Figure. The lower or first portion 14 of the pump assembly also has an inlet flange 46 extending from its lower or inlet end 16, and the upper or second portion 18 has an identical outlet flange 48 extending from its outlet end 20. The inlet and outlet flanges 46 and 48 provide for the connection of the pump 10 to external liquid passages.

It will be noted that the upper portion of the pump 10 includes an additional component, i.e., an impervious sleeve 50 disposed concentrically within the upper portion 18 of the pump body 12, as shown in FIGS. 2 and 3. The outer diameter of the sleeve 50 is slightly smaller than the inside diameter of the upper portion 18, the sleeve 50 and the upper body portion 18 defining a narrow, axially peripheral and toroidal gas injection plenum 52 therebetween. The sleeve 50 has a radially outwardly extending flange 54 at its lower end, the second medial flange 42 having a relief in its face to capture the sleeve flange 54 between the two medial flanges 40 and 42. The second medial flange 42 may also be configured with an O-ring groove to accept an O-ring seal 56 therein. Additional O-rings may be installed in mating grooves provided at various locations in the pump 10 assembly for proper sealing of the apparatus. The sleeve flange 54 serves to seal the lower end of the sleeve 50 to the pump body 12 so that only the opposite upper end of the sleeve 50 remains open between the sleeve and the adjacent inner wall or surface of the upper portion 18 of the pump assembly.

The elevation view in section of FIG. 3 serves to show the gas flow paths through the pump 10. Gas is initially delivered to the pump 10 to either or both of the gas delivery tube sets 32 and/or 34 extending radially from their respective gas delivery collars 28 and 30. The gas may be delivered independently to each collar 28 and/or 30, or from a common source to both collars. However, it is preferred that gas be delivered simultaneously to both collars 28 and 30 for increased operational efficiency of the pump 10. The specific gas flow paths for each delivery collar 28 and 30 are described separately below.

Gas entering the lower or first delivery collar 28 by means of its delivery tubes 32 initially passes into the lower or first gas delivery plenum 36 between the first collar 28 and the lower or first portion 14 of the pump body 12. From the delivery plenum 36, the gas flows through the radially disposed small perforations 24 formed through the wall of the first portion 14 of the pump body 12 so that the gas is injected radially inward under pressure into the liquid flow passage 22 through the pump body 12 to entrain and add buoyancy to the liquid therein.

Gas entering the upper or second delivery collar 30 by means of its gas delivery tubes 34 initially passes into the upper or second gas delivery plenum 38 defined between the second collar 30 and the upper or second portion 18 of the pump body 12. From the delivery plenum 38, the gas flows through the second gas flow passages 26 formed through the wall of the second portion 18 of the pump body 12. However, it will be seen that this gas flow cannot flow directly radially inwardly into the liquid within the flow passage 22 through the pump body 12 due to the impervious sleeve 40 installed immediately within the second portion 18 of the pump body 12. Rather, the gas is forced to flow upward to the open upper end of the sleeve 40 (the sleeve 50 is shorter in height than the upper portion 18 of the pump body 12) along the narrow toroidal gas injection plenum 52 defined between the inner surface or wall of the second portion 18 of the pump body 12 and the outer surface of the sleeve 40, entering the liquid flow in an axial direction.

This dual stage or gas flow path for the dual injection airlift pump 10 provides significant increases in efficiency for the pump in comparison to conventional airlift pumps. The radially inward gas flow provided by the lower or first portion 14 of the pump body causes the gas to penetrate inwardly toward the center of the liquid in the flow path 22, thereby infusing the liquid with gas bubbles that rise in the liquid due to their lighter density. This tends to entrain the greater volume of liquid within the flow path 22, and further adds buoyancy to the liquid to cause it to rise through the pump body 12. The axial peripheral gas flow provided by the sleeve 40 in the upper or second portion 18 of the pump body 12 reduces contact of the liquid with the inner wall or surface of the second portion 18 of the pump body, thereby reducing hydrodynamic friction between the liquid and the wall of the second portion 18. The lighter gas also serves to entrain the liquid within the flow path and to add buoyancy to the liquid, but performs most of these function along or near to the inner surface of the second portion 18 of the pump body. The combination of the two gas flow paths into the liquid within the pump 10 therefore provides greatly improved efficiency in comparison to conventional airlift pumps.

It is to be understood that the present invention is not limited to the embodiments described above, but encompasses any and all embodiments within the scope of the following claims.

We claim:

1. A dual injection airlift pump, comprising:

a hollow, tubular pump body having a lower portion defining a lower inlet end and an upper portion defining an upper outlet end opposite the lower inlet end, the pump body defining a liquid flow passage disposed axially therethrough, at least one portion of the pump body having a plurality of perforations formed therein defining radially disposed gas flow passages through the pump body, wherein the lower portion of the hollow, tubular pump body has a first plurality of gas flow passages disposed radially therethrough and the upper portion of the hollow, tubular pump body has a second plurality of gas flow passages disposed radially therethrough;

at least one gas delivery collar surrounding the portion of the pump body having gas flow passages defined therein, the gas delivery collar and the pump body defining a toroidal gas delivery plenum therebetween, wherein the at least one gas delivery collar comprises:

a first gas delivery collar surrounding the lower portion of the pump body, the first gas delivery collar and the lower portion of the pump body defining a first said toroidal gas delivery plenum therebetween, the radially disposed gas flow passages permitting delivery of a gas under pressure from the gas delivery plenum to the liquid flow passage of the lower portion of the pump body; and a second gas delivery collar surrounding the upper portion of the pump body, the second gas delivery collar and the upper portion of the pump body defining a second said toroidal gas delivery plenum therebetween, whereby the radially disposed gas flow passages permit delivery of a gas under pressure from the gas delivery plenum to the liquid flow passage of the pump body in order to pump a liquid through the pump body through buoyant effect of the pressurized gas; and an impervious sleeve disposed within the upper portion of the pump body, the sleeve having a lower end sealed to the pump body and an open upper end, the sleeve having a height less than the upper portion of the pump body, the sleeve and the upper portion of the pump body defining an annular, axially extending flow path joining the liquid flow passage above the open end of the sleeve, the gas flow passages of the upper portion of the pump body permitting gas under pressure to flow from the second toroidal gas delivery plenum into the axially extending flow path and then into the liquid flow passage in an axial direction.

2. The dual injection airlift pump according to claim 1, wherein the gas flow passages of the at least one portion of the pump body are circumferentially disposed evenly and symmetrically about the pump body.

3. The dual injection airlift pump according to claim 1, wherein the at least one gas delivery collar further includes a plurality of circumferentially symmetrically disposed gas delivery tubes extending radially therefrom, the tubes being adapted for delivering a gas under pressure into said toroidal gas delivery plenum.

4. The dual injection airlift pump according to claim 1, wherein the lower portion of the hollow, tubular pump body has a first medial flange disposed opposite the lower end, and the upper portion has a second medial flange disposed opposite the upper end, the first medial flange connecting to the second medial flange.

5. The dual injection airlift pump according to claim 1, further comprising:

an inlet end flange disposed upon the lower end of the pump body; and an outlet end flange disposed upon the upper end of the pump body.

6. A dual injection airlift pump, comprising:

a hollow, tubular pump body having a lower portion defining a lower inlet end and an upper portion defining an upper outlet end opposite the inlet end, the pump body defining a liquid flow passage disposed axially therethrough, the lower portion of the pump body having a first plurality of perforations defining gas flow passages therethrough, the upper portion of the pump body including a second plurality of perforations defining gas flow passages therethrough;

a first gas delivery collar surrounding the lower portion of the pump body, the first gas delivery collar and the lower portion of the pump body defining a first toroidal gas delivery plenum therebetween;

a second gas delivery collar surrounding the upper portion of the pump body, the second gas delivery collar and the upper portion of the pump body defining a second toroidal gas delivery plenum therebetween, the gas flow passages permitting a gas under pressure to flow from the gas delivery plenums into the liquid flow passage of the pump body in order to pump a liquid through the pump body through buoyant effect of the pressurized gas; and an impervious sleeve disposed within the upper portion of the pump body, the sleeve having a lower end sealed to the pump body and an open upper end, the sleeve having a height less than the upper portion of the pump body, the sleeve and the upper portion of the pump body defining a narrow, annular, axially extending gas flow passage therebetween, the gas flow passages of the upper portion of the pump body permitting the pressurized gas to flow from the second toroidal gas delivery plenum into the axially extending gas flow passage and then join into the liquid flow passage in an axial direction above the open end of the sleeve.

7. The dual injection airlift pump according to claim 6, wherein the first plurality of gas flow passages and the second plurality of gas flow passages are radially disposed through the respective portions of the pump body.

8. The dual injection airlift pump according to claim 6, wherein the first plurality of gas flow passages and the second plurality of gas flow passages are circumferentially disposed evenly and symmetrically about the respective portions of the pump body.

9. The dual injection airlift pump according to claim 6, wherein the each gas delivery collar further includes a plurality of circumferentially symmetrically disposed gas delivery tubes extending radially therefrom.

10. The dual injection airlift pump according to claim 6, wherein:

the lower portion of the pump body has a first medial flange disposed opposite the lower end; and the upper portion of the pump body has a second medial flange disposed opposite the upper end, the first medial flange connecting to the second medial flange.

11. The dual injection airlift pump according to claim 6, further comprising:

an inlet end flange disposed upon the lower end of the pump body; and an outlet end flange disposed upon the upper end of the pump body.

* * * * *